United States Patent [19]

Hwang et al.

[11] Patent Number: 5,046,318

[45] Date of Patent: Sep. 10, 1991

[54] TURBINE POWER PLANT AUTOMATIC CONTROL SYSTEM

[75] Inventors: Edward Y. Hwang, Winter Park; John R. Doyle, Winter Springs, both of Fla.

[73] Assignee: Westinghouse Electric Corp., Pittsburgh, Pa.

[21] Appl. No.: 489,439

[22] Filed: Mar. 5, 1990

[51] Int. Cl.[5] ..... F01K 13/02

[52] U.S. Cl. ..... 60/646

[58] Field of Search ..... 60/646, 657

[56] References Cited

U.S. PATENT DOCUMENTS

| | | | |
|---|---|---|---|
| 4,029,951 | 6/1977 | Berry et al. | 235/151.21 |
| 4,811,565 | 3/1989 | Hwang | 60/646 |
| 4,866,940 | 9/1989 | Hwang et al. | 60/646 |

*Primary Examiner*—Allen M. Ostrager

[57] ABSTRACT

The disclosed system overlaps the control operation for throttle and governor valves to shorten a steam chest warmup period by fully opening a pilot valve and closing down the governor valve to maintain rolling speed when the steam chest needs wraming and the throttle valve - governor valve transfer speed has not been reached. The system also sets a minimum rate of acceleration for vibration run through periods and allows speed changes at designated periodic speed change windows as long as stress is within an allowable range. The system further eliminates vibration transients during a speed change operation by providing a smoothed trend preventing speed holds from increasing unnecessarily.

3 Claims, 5 Drawing Sheets

TURBINE POWER PLANT AUTOMATIC CONTROL SYSTEM

BACKGROUND OF THE INVENTION

1. Field of the Invention

The present invention is directed to an improved turbine power plant control system and, more particularly, to a system that reduces overall start up time for the turbine by overlapping a steam chest warming operation, speeding up shaft critical run through, and shortening vibration run up.

2. Description of the Related Art

Turbine power systems typically include a high pressure turbine section where the steam is introduced from the steam generator. The steam from the high pressure turbine section after being reheated is introduced into a reheat turbine section, which in the case of a fossil fired steam generating system is commonly termed the intermediate pressure turbine section and then into a low pressure turbine section before exhausting to the condenser. A rotor having an axial bore passes centrally through the turbine casing and rotation of the rotor is achieved by passage of steam over blades affixed to the rotor revolving in the casing. The generator which is affixed to the rotor may be cooled by hydrogen gas. A steam chest on both the right and left sides of the turbine includes throttle valves and governor valves for controlling the steam applied to the high pressure turbine. The metal mass of the steam chest must be brought to operating temperature before the full pressure of the supplied steam can be admitted into the steam chest.

In a typical startup, the pilot valves within the throttle valves admit the steam flow through the steam chest into the turbine to control the turbine speed. All the governor valves are wide open since the amount of the steam flow is far below their controllable range. At approximately ninety percent of the rated speed, the governor valves are closed downward until a speed drop occurs, indicating the governor valves have taken control or the steam flow, then the pilot valves and throttle valves are ramped upward all the way to wide open, thereby transferring control to the governor valves In a typical or conventional warm start, after a weekend shutdown, the inlet steam to the turbine is colder than the rotor surface and the turbo generator unit will go through a period of forced cooling to roll up to the valve transfer speed. The transfer is, in most cases delayed because of a cold steam chest inner metal temperature, thus prolonging the forced cooling of the rotor and creating high thermal stresses that, in turn, affect later acceleration. The warming of the steam chest is rather slow because very little steam is emitted through the throttle pilot valves. During a warm start, the rotor reaches the ninety percent rated speed point before the steam chest reaches operating temperature, requiring that the throttle valves continue to control until the steam chest reaches the saturation temperature at the existing pressure. This is what prolongs rotor cooling and increases rotor stress.

What is needed is a system which will lower or close the governor valves to maintain rolling speed and open the throttle valve pilot valve to the full stroke, thereby overlapping the throttle valve and governor valve control mode and partially pressurizing the steam chest. This will allow more steam to flow through the steam chest and the warming process can be shortened significantly while still maintaining rolling speed.

During the operation for controlling the power plant from cold, warm or hot start up to application of a full load the conventional automatic control system provides for accelerating the turbine from zero speed through heat soak speed to synchronous speed in accordance with the real time thermal stresses in the system. During such control, the system can vary the rate of acceleration by either stopping acceleration altogether, holding it constant, increasing it or decreasing it. Conventional control operations allow the rate of acceleration to be reduced below a value at which stress is not a problem even though this is not necessary, thereby resulting in further inefficiencies in the start up operation. What is needed is a system that will only fall to a minimum rate of acceleration for the unit to run through shaft critical and blade resonant speed ranges. This minimum will keep rotor stress within an allowable range. Such a system which will not restrict the rate of increase because of time delay requirements between speed changes and thereby miss speed windows.

In conventional systems, during vibration run down, run through and run up operations a five minute counter is maintained to track the trending of vibration measurements. The system is looking for a monotonous decreasing trend. Any spike or blip in a trend reading that is counter to the monotonous decreasing trend resets the counter and restarts the five minute count. What is needed is a system which determines the rate of trending and prevents the resetting of the counter by a single spike or blip in the readings.

SUMMARY OF THE INVENTION

It is an object of the present invention to improve turbine operation and turbine operation efficiency.

It is another object of the present invention to shorten the steam chest warming operation during a turbine start up operation.

It is also an object of the present invention to speed up the critical shaft run through operation during turbine start up.

It is another object of the present invention to shorten the vibration run up.

The above objects can be attained by a system that overlaps the control operation for throttle and governor valves to shorten the steam chest warmup period. The system also sets a minimum rate of acceleration and allows speed changes at speed change windows as long as the stress is within an allowable range. The system further eliminates vibration transients during a speed change operation by smoothing trends.

These together with other objects and advantages which will be subsequently apparent, reside in the details of construction and operation as more fully hereinafter described and claimed. Reference being had to the accompanying drawings forming a part hereof, wherein like numerals refer to like parts throughout.

DESCRIPTION OF THE PREFERRED EMBODIMENT

The present invention is directed to an improvement in a turbine power plant automatic control system as described in U.S. Pat. No. 4,029,951 incorporated by reference herein. This patent provides detailed descriptions of the turbine power plant, the control system for the plant and the software executing within the control system. A system as described in U.S. Pat. No. 4,029,951 is available from Westinghouse and is called the Automatic Turbine Control (ATC) System. The present invention improves on the ATC system. The present invention is particularly directed to improvements in the sequence control routine-P15, the rate control routine-P07 and the eccentricity and vibration routine-P05 illustrated in FIG. 3 of U.S. Pat. No. 4,029,951.

Figure 1:
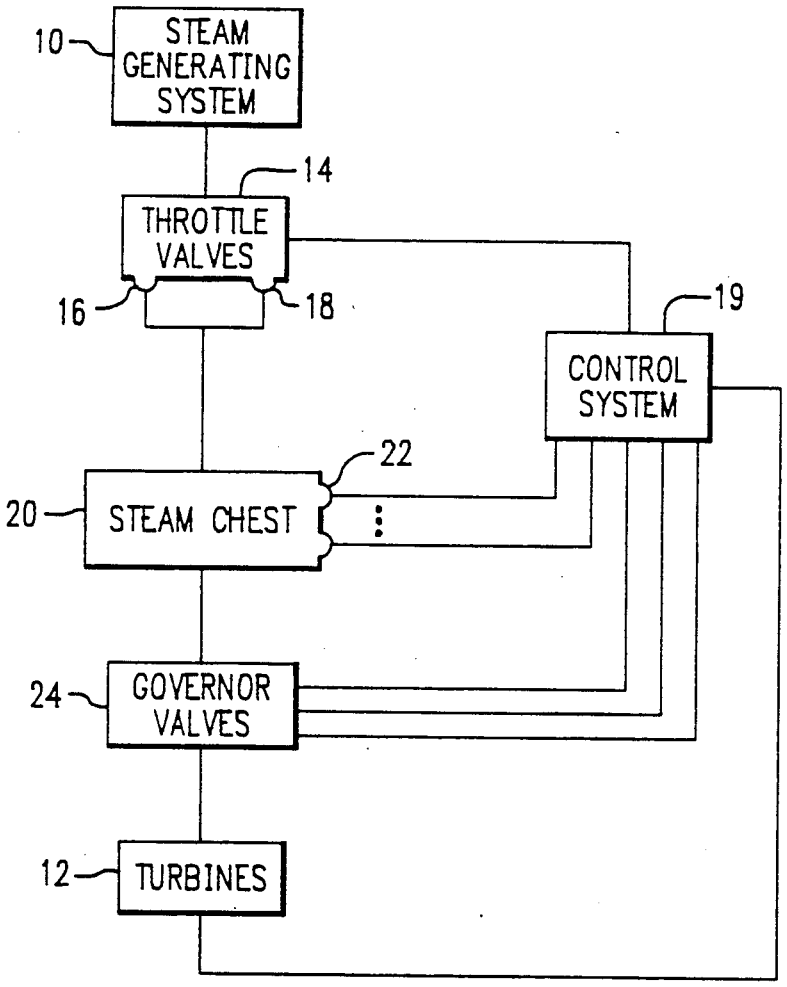
FIG. 1 illustrates the components of a turbine generator unit concerned with the present invention.

A turbine power plant as illustrated in FIG. 1 includes a steam generating system 10 which supplies steam to a turbine 12 through throttle valves 14. The throttle valves 14 include a main valve 16 and a pilot valve 18 both controlled by the control system 19. The pilot valve 18 is actually a valve within the main valve 16 but is shown separately for convenience. The throttle valves 14 supply steam to a steam chest 20 which includes temperature sensors 22 which are used by the control system 19 to monitor the temperature of the steam chest 20. The steam chest 20 provides steam to the governor valves 24 also controlled by the control system 19. The governor valves 24 provide the turbine 12 with steam. The turbine 12 has temperature, stress, speed and vibration sensors which are used by the control system 19 to monitor stress, vibration, speed and acceleration.

Figure 2:
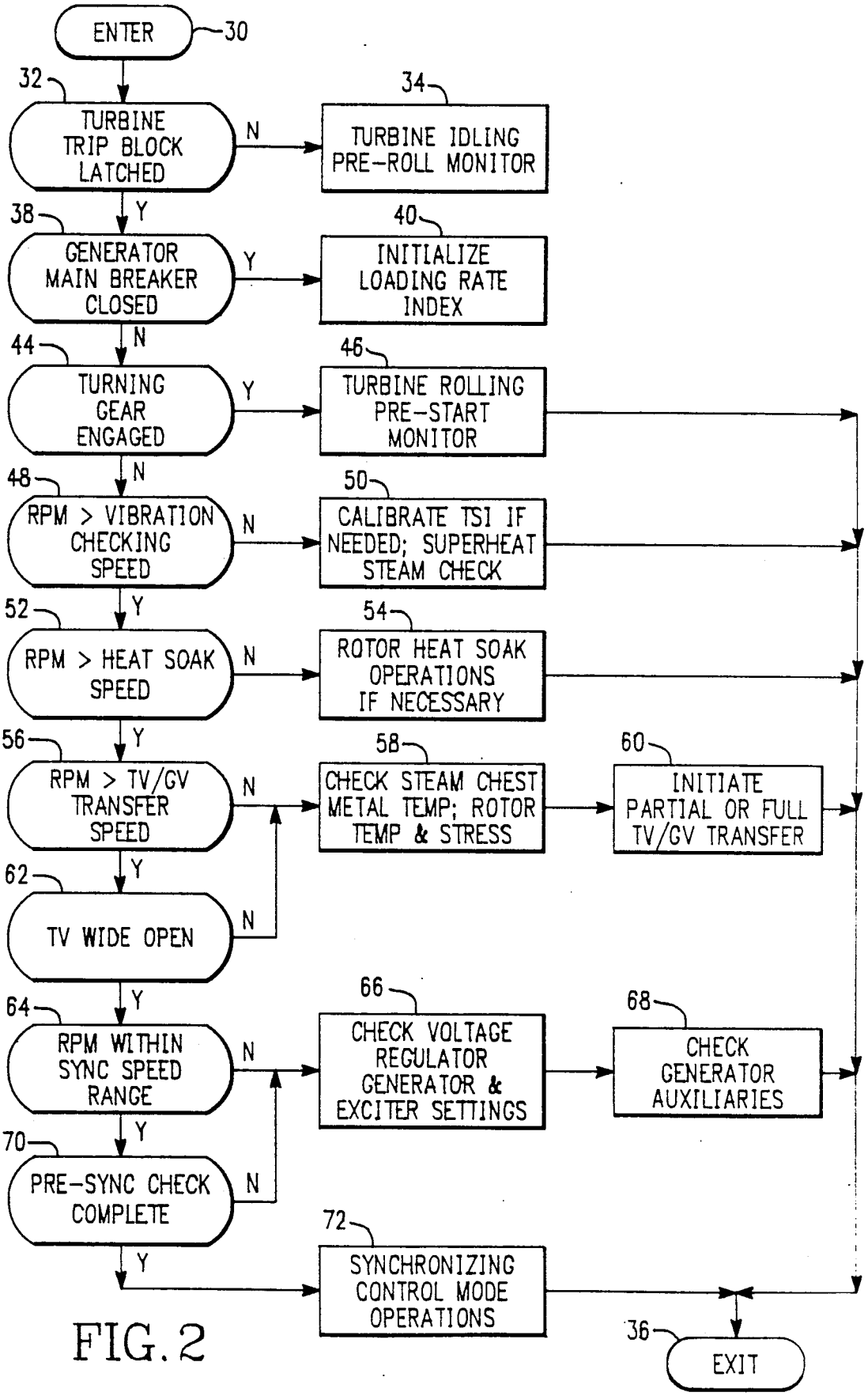
FIG. 2 illustrates a start up sequence control routine.

The conventional system available from Westinghouse and described in the above-mentioned patent requires that the steam chest be sufficiently warm before transferring control of steam flow from the throttle valves to the governor valves. If the steam chest metal temperature is less than the steam saturation temperature at existing pressure, then the transfer is delayed to allow the steam chest to heat up more. The present invention improves the start up sequence by shortening the steam chest warm up process through lowering the governor valves 24 to maintain rolling speed and opening the pilot valve 18 of the throttle valves 14 to the full stroke, thereby overlapping the throttle valve 14 and governor valve 24 control mode to partially pressurize the steam chest and allow more steam to flow into the steam chest as illustrated in FIG. 2. This routine would be substituted for the P15 routine of U.S. Pat. No. 4,029,951.

The routine of FIG. 2 starts by determining 32 whether the turbine trip block is latched, if not, conventional turbine idling preroll monitoring is performed 34 followed by an exit 36. If the turbine block is latched, a check is made 38 to determine whether the generator main breaker is closed and if so, the load rate index is conventionally initialized 40 and the routine is again exited 36. If the main generator breaker is not closed, a determination 44 is made concerning whether the turning gear is engaged and, if so, a standard turbine rolling prestart monitoring operation is performed 46 followed by an exit 36. If the turning gear is not engaged, the RPM of the turbine is checked to determine whether it is greater than the vibration checking speed, if so a conventional calibration and steam check routine 50 is performed followed by an exit 36. If the RPM is not greater than the heat soak speed 52, conventional rotor heat soak operations 54 are performed, if necessary, followed by an exit 36.

If the rotational speed is greater than the heat soak speed, then the system is in the vicinity of the valve transfer speed and the improved transfer control of the present invention can be performed. If the RPM is not greater than the throttle valve - governor valve transfer speed 56, which is 90% of rated speed unless this speed is too close to the shaft critical or blade resonant ranges, in which case the speed is different, the steam chest metal temperature, rotor temperature and stress are checked 58 in a conventional manner. If the steam chest temperature is sufficient (greater than the throttle steam saturation temperature at existing pressure) then a full transfer of control from the throttle valves 14 to the governor valves in the conventional manner is performed. If the temperature is not sufficient a partial transfer occurs whereby the governor valves 24 are closed downward until a speed drop of 30 rpm occurs indicating the governor valves are in control and then the pilot valve 18 of the throttle valve 14 is fully opened. The main throttle valve remains closed until the full valve transfer mentioned above takes place. This operation overlaps the throttle valve 14 and governor valve 24 operations, partially pressurizing the steam chest 20, allowing more steam to enter and heat the steam chest 20 faster. When the test 58 is encountered in later cycles of the program and the steam chest temperature is sufficient, a conventional full transfer operation is performed during which the main throttle valve is opened all the way.

If the RPM is greater than the throttle valve transfer speed, the throttle valve is checked 62 to see if it is wide open. If it is not, then the temperature check and stress check 58 followed by the partial or full transfer operation 60 discussed above is performed. If the throttle valve 14 is wide open then a determination is made 64 concerning whether the rotating speed is within the synchronization speed and if not, the voltage regulator generator and excitor winding settings are conventionally checked 66 followed by a conventional check 68 of the generator auxiliaries. If the rotating speed is within the synchronization speed range, a presynchronization check completion determination 70 is made. If the presychronization check 70 is completed, the system moves into a conventional synchronizing control mode operation 72.

Figure 3:
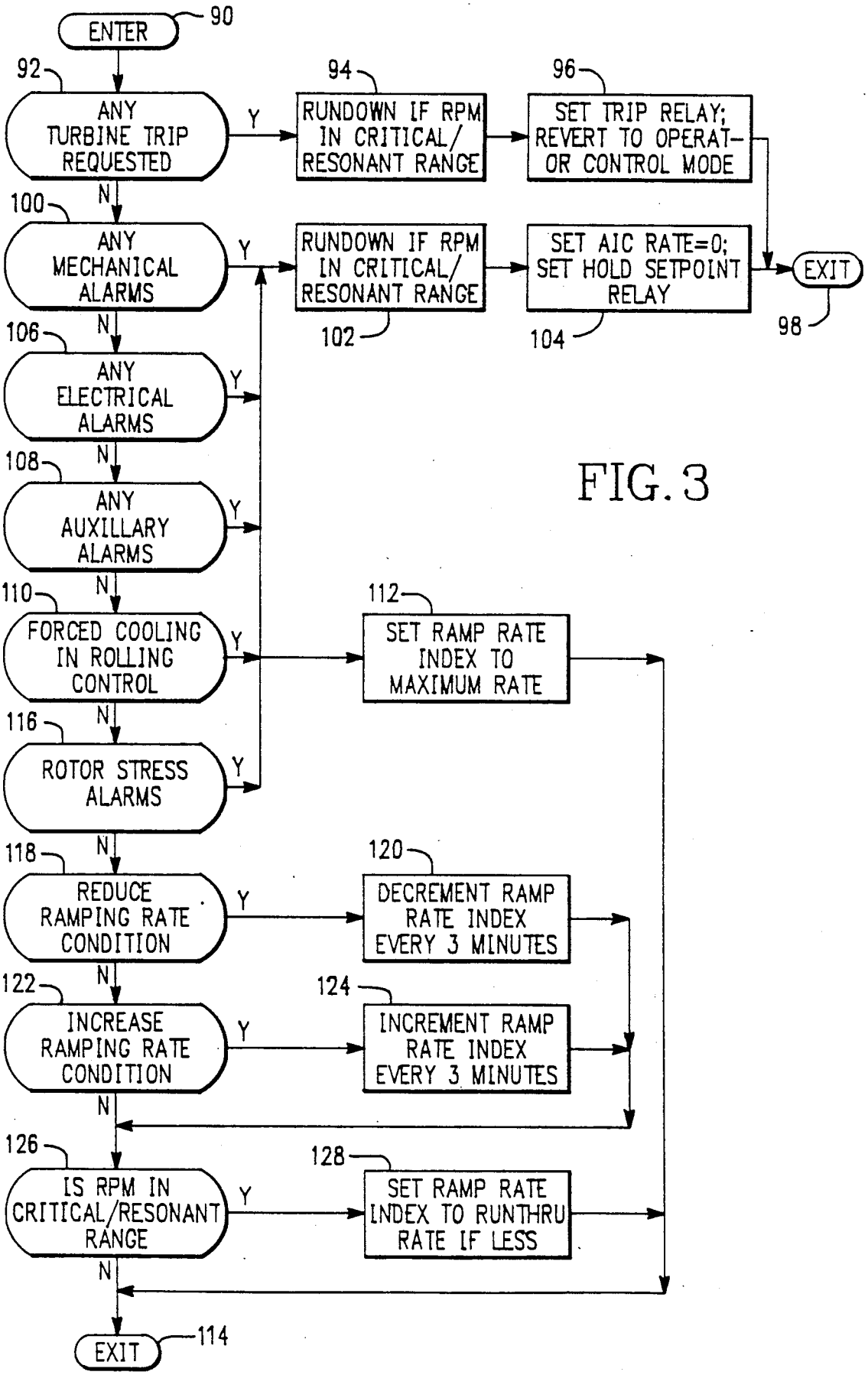
FIG. 3 illustrates a ramping rate control routine.

To improve ramping rate control the routine illustrated in FIG. 3 is substituted for the P07 routine of U.S. Pat. No. 4,029,951. This routine, as does the P07 routine, starts by conventionally determining 92 whether one of several turbine trips have been requested, if so, a conventional run down 94 is performed if the rotational speed is in the critical/resonant range followed by conventional setting 96 of the trip relay and changing over to an operator control mode If a trip has not been requested conventional checks 100 are performed concerning whether there are any mechanical alarms and, if so, a conventional run down 102 is performed under the same conditions as previously mentioned and the automatic control rate is conventionally set 104. If any of conventionally detected electrical alarms 106, auxiliary alarms 108 or rotor stress alarms 116 have occurred, this same run down sequence 102 and 104 are performed. If no auxiliary alarms exist and forced cooling 110 during rolling control is to occur, the ramp rate index is set to the maximum 112. If no rotor stress alarms have occurred, the rate control portion of the routine, that limits the acceleration rate reduction to a minimum, is entered. At the beginning of this portion of the routine, a conventional determination is made 118 concerning whether the ramping rate condition must be reduced and if so, the ramping rate index is decreased 120 every three minutes. If the ramping rate need not be reduced, a conventional check 122 is performed concerning whether the ramping rate can be increased. If so, the ramping rate index is incremented 124 every three minutes. In the reduction or increasing or no change situations, a test 126 is always performed to determine whether the RPM is in a critical or resonance range. Existing systems have one unit dependent shaft critical speed range and up to four low pressure turbine blade resonant speed ranges. If the speed is within one of the ranges, the ramping rate or increase in acceleration is set at the minimum rate if any previous operation resulted in a setting of the rate to less than the minimum. The minimum rate is determined by the design engineer in concordance with the turbine operation engineer. The minimum is usually around 80% of the acceleration index range which is 400 rpm/min. for a fossil fuel unit and 200 rpm/min. for a nuclear unit. The setting of the minimum rate forces the system to pass through the critical/resonant ranges at the minimum run through acceleration rate even when the rate would normally be reduced to below the run through rate by other portions of the rate control process. This forces the system to pass through the critical and resonant ranges quicker than during conventional ramping rate control operations.

Figure 4:
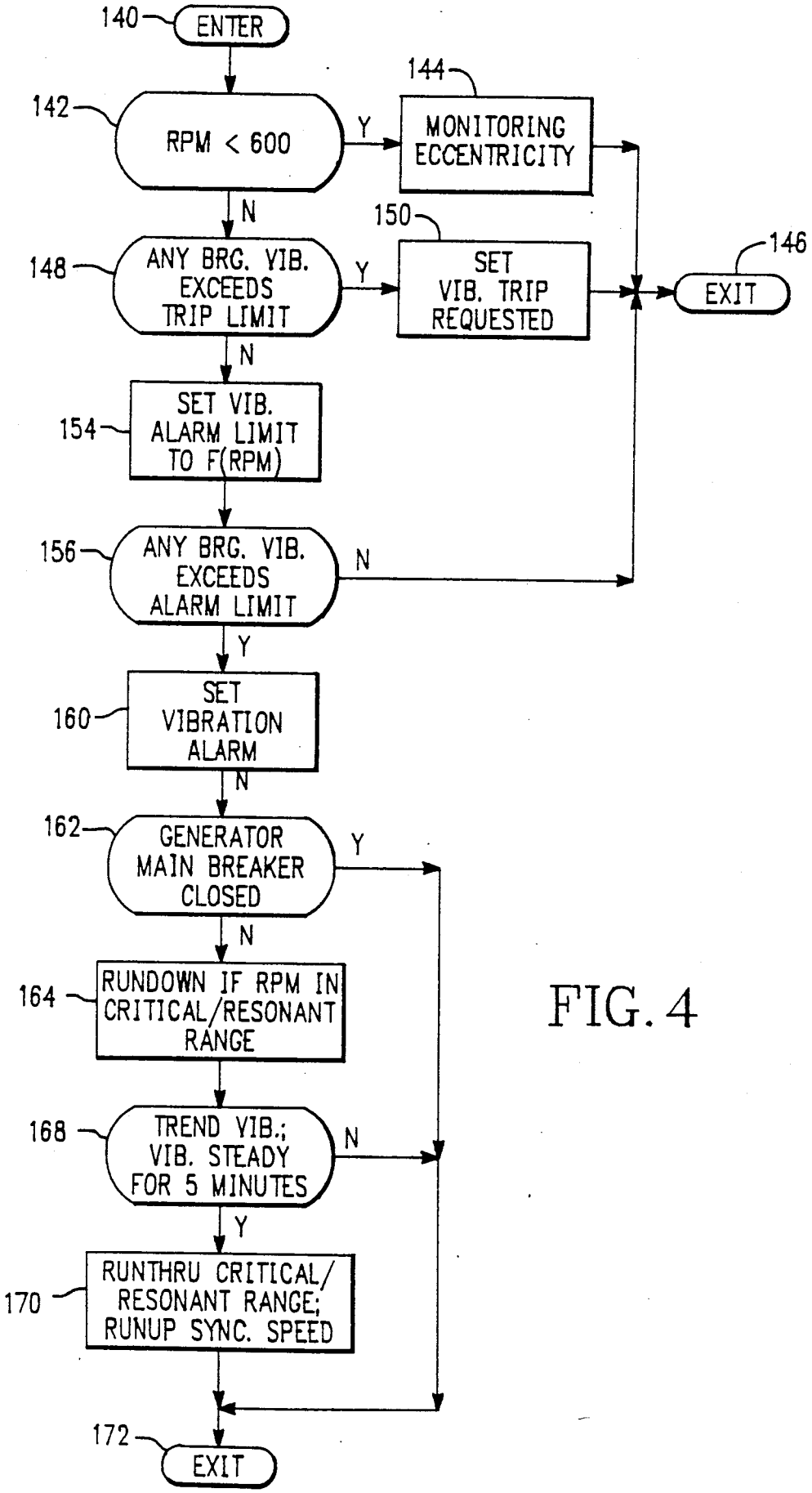
FIG. 4 illustrates an eccentricity and vibration routine.
Figure 5:
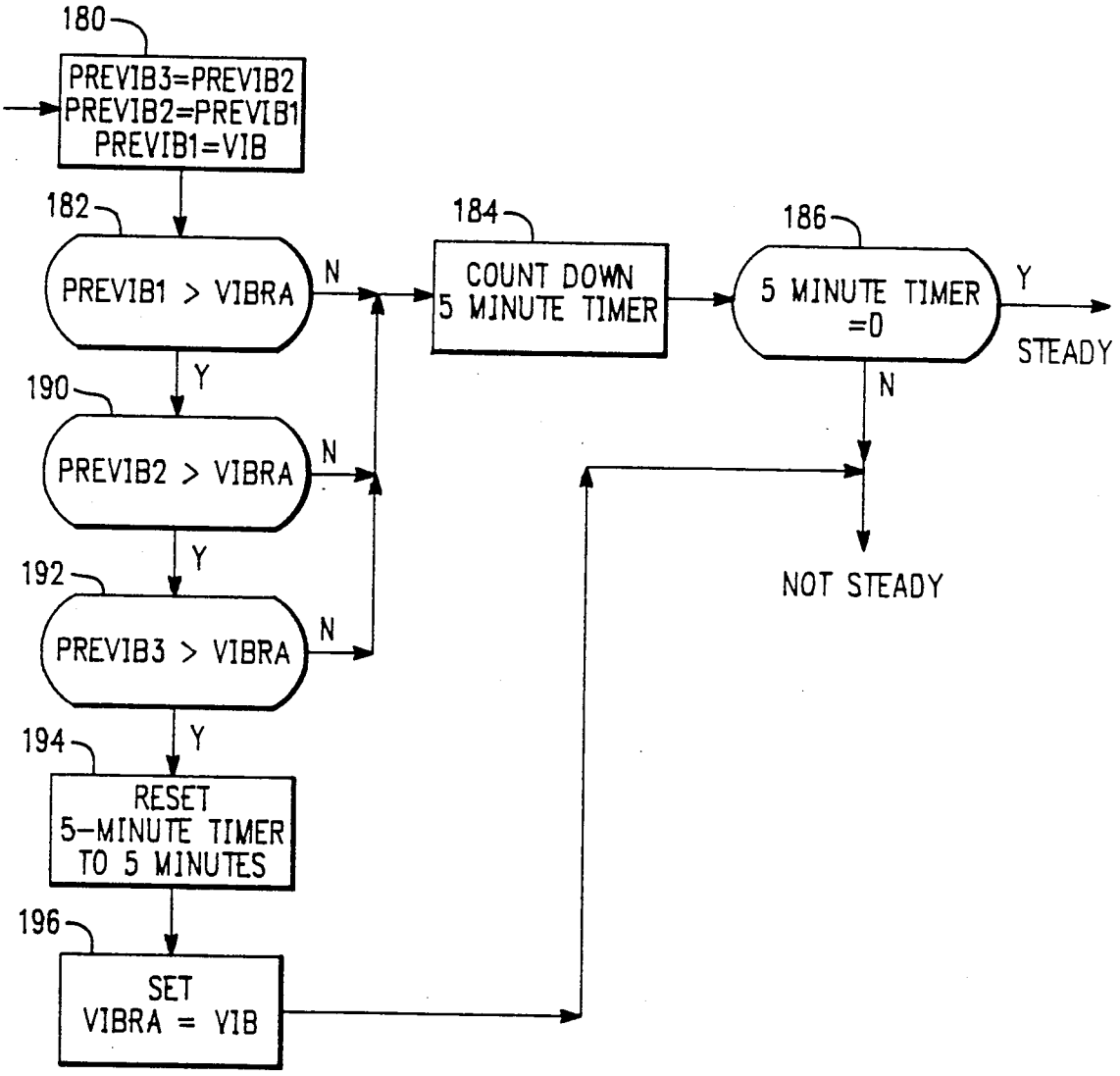
FIG. 5 illustrates the trending step of the routine of FIG. 4.

To improve the eccentricity and vibration routine-P05 of U.S. Pat. No. 4,029,951, the routines of FIGS. 4 and 5 are provided. These routines can be incorporated into a system such as the Automatic Turbine Control System produced by Westinghouse. The conventional routine, currently found in the ATC, monitors eccentricity and vibration. Eccentricity is monitored only at a speed lower than 600 RPM with only a single sensor. Vibration monitoring involves a sensor per bearing requiring 7 to 11 readings depending on the configuration. If eccentricity exceeds an alarm limit, an indicator is set, which will cause the speed control program of FIG. 3 to institute a speed hold. Vibration, however, is monitored throughout the speed and load range as long as the vibration output from the supervisory instrumentation is valid. With respect to vibration, the first action the conventional routine takes is to establish alarm and trip limits The vibration alarm limits are a function of speed. At lower speeds, the routine allows more vibration. As turbine speed approaches the throttle valve to governor valve transfer speed, the vibration alarm limit linearly decreases to its minimum value of 5 mils (7 mils for nuclear units).

Once the alarm and trip limits have been established, the conventional routine proceeds to compare the vibration reading at each bearing to these limits. If any vibration input is greater than or equal to the trip limit, then a trip is requested and control reverts to the operator. Prior to this action, the bearing vibration will first have gone through the alarm level at which time the operator will be alerted and should take action to prevent the vibration from reaching the trip limit. If the vibration at any bearing exceeds an alarm limit, but is less than the trip limit, then the action taken by the conventional routine will depend on whether or not the present turbine speed is within a low pressure turbine blade resonant speed range or the first exciter critical speed range. The conventional routine avoids instituting speed holds within the resonant ranges of these blades. If any bearing goes into alarm, the conventional routine will begin trending that bearing on a one minute basis to determine if the vibration at that bearing is increasing, decreasing or constant. If the trend does not indicate a decreasing trend then a predetermined time limit, such as 15 minute, speed hold is instituted. The conventional routine determines that a decreasing trend has stopped whenever a single vibration reading increases. Such blips reset a five minute trend count which, if it expires allows an increase in speed to occur.

The vibration and eccentricity routine of the present invention illustrated in FIGS. 4 and 5 starts by determining 142 whether the rolling speed is less than 600 RPM. If so, conventional monitoring of eccentricity 144 is performed followed by an exit 146. If the speed is greater than 600 RPM, a conventional check is made 148 to determine whether any bearing vibration exceeds the trip limit. If so, the vibration trip request is set 150. If no bearing vibration exceeds the trip limit, the vibration alarm limit is set 154 to be a linear function of RPM. Next a determination 156 is made concerning whether any bearing vibration exceeds the alarm limit. If so, the vibration alarm is set 160 followed by a conventional determination 162 of whether the generator main breaker is closed. If the breaker is not closed, a conventional run down operation 164 is performed. The present invention then departs from the conventional eccentricity and vibration routine and performs a check 168 to determine whether the vibration trend has been steady for 5 minutes using a method that eliminates the transients in the vibration signal. This check 168 will be discussed in more detail with respect to FIG. 5. If the vibration has been steady for five minutes then the conventional run through operation through the critical and resonant ranges up to the synchronous speed is performed 170 allowing speed changes at the designated speed change windows preventing transients from causing windows to be missed.

As previously mentioned, the conventional vibration routine resets a five minute countdown timer each time the current vibration exceeds the previous vibration, thereby resetting the countdown timer each time a transient in the vibration trend occurs. The present invention removes these transients by first setting 180 three stored vibration amounts, as illustrated in FIG. 5, using the current vibration as the first of these and the two previous vibrations as the other two. Next a last reset vibration amount, stored the last time the count down was reset, is compared 182–192 to the three stored vibrations. If the last reset vibration is less than any of the previous three vibrations the countdown timer is counted down 184 followed by a check 186 to determine whether the timer is equal to zero. If the last reset vibration exceeds all three of the stored vibrations then the countdown timer is reset 194 to the five minute countdown time followed by a setting 196 of the last reset vibration. This trending routine will eliminate a transient up to three samples wide or fifteen seconds wide. By eliminating one of the tests 182, 190 or 192, the routine will eliminate a transient up to two samples wide. The number of tests could of course be increased to eliminate wider transients.

The many features and advantages of the invention are apparent from the detailed specification and, thus, it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described and accordingly all suitable modifications and equivalents may be resorted to, falling within the scope of the invention.

What we claim is:

1. A method of controlling a pilot valve of a throttle valve and a governor valve of a steam turbine including a steam chest coupled to the throttle and governor valves, comprising the step of:

(a) overlapping operation of the pilot valve of the throttle valve and the governor valve by lowering the governor valve and opening the pilot valve and thereby partially pressurizing the steam chest of the turbine and maintaining rolling speed during start up.

2. A method as recited in claim 1, wherein step (a) comprises the step of:

(a1) closing the governor valve to maintain rolling speed; and (a2) fully opening a pilot valve of the throttle valve.

3. A method as recited in claim 2, wherein steps (1) and (2) are performed when turbine speed is not greater than a throttle valve/governor valve transfer speed or when the turbine speed is greater than the throttle valve/governor valve transfer speed and the throttle valve is not wide open.

* * * * *